US007168174B2

(12) United States Patent
Piekutowski

(10) Patent No.: US 7,168,174 B2
(45) Date of Patent: Jan. 30, 2007

(54) METHOD AND APPARATUS FOR MACHINE ELEMENT CONTROL

(75) Inventor: Richard Paul Piekutowski, Huber Heights, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 5 days.

(21) Appl. No.: 11/079,846

(22) Filed: Mar. 14, 2005

(65) Prior Publication Data

US 2006/0201007 A1 Sep. 14, 2006

(51) Int. Cl.
*G01C 11/26* (2006.01)
*G05B 19/18* (2006.01)

(52) U.S. Cl. ..... 33/286; 33/290; 33/1 CC

(58) Field of Classification Search ..... None
See application file for complete search history.

(56) References Cited

U.S. PATENT DOCUMENTS 3,462,845 A * 8/1969 Matthews ..... 33/290
4,044,372 A 8/1977 Weinstein
4,044,377 A 8/1977 Bowerman
4,053,893 A 10/1977 Boyer
4,396,945 A 8/1983 DiMatteo et al.
4,472,978 A 9/1984 Levine et al.
4,691,385 A 9/1987 Tupman
4,764,668 A 8/1988 Hayard
4,807,131 A 2/1989 Clegg
5,000,564 A 3/1991 Ake
5,174,385 A 12/1992 Shinbo et al.
5,313,409 A 5/1994 Wiklund et al.
5,347,387 A 9/1994 Rice
5,359,889 A 11/1994 Jircitano et al.
5,404,661 A 4/1995 Sahm et al.
5,416,976 A 5/1995 Hane et al.
5,440,392 A 8/1995 Pettersen et al.
5,572,809 A 11/1996 Steenwyk et al.
5,606,444 A 2/1997 Johnson et al.
5,612,864 A 3/1997 Henderson
5,617,335 A 4/1997 Hashima et al.
5,682,311 A 10/1997 Clark
5,704,429 A 1/1998 Lee et al.
5,713,144 A 2/1998 Haraoka
5,719,500 A 2/1998 Eschner et al.
5,754,137 A 5/1998 Durrstein
5,764,511 A 6/1998 Henderson (Continued)

FOREIGN PATENT DOCUMENTS

EP 0 706 105 A1 4/1996

(Continued)

*Primary Examiner*—Christopher W. Fulton
(74) *Attorney, Agent, or Firm*—Dinsmore & Shohl LLP

(57) ABSTRACT

A method of monitoring the location, and the orientation of a machine element, and apparatus for monitoring and controlling the operation of the machine include a robotic total station and a plurality of targets in known positions relative to the machine element. The total station, located at a known location near the machine element, repeatedly, successively determines the location of each target. Acquisition and re-acquisition of the targets is aided by stored data regarding the prior locations and movements of the targets. Further, active targets may be used to facilitate re-acquisition. The operation of the machine is controlled based upon the location and orientation of the machine element.

15 Claims, 3 Drawing Sheets

U.S. PATENT DOCUMENTS

| | | | |
|---|---|---|---|
| 5,771,978 | A | 6/1998 | Davidson et al. |
| 5,774,832 | A | 6/1998 | Vanderwerf |
| 5,798,733 | A | 8/1998 | Ethridge |
| 5,848,368 | A | 12/1998 | Allen et al. |
| 5,848,485 | A | 12/1998 | Anderson et al. |
| 5,875,854 | A | 3/1999 | Yamamoto et al. |
| 5,878,977 | A | 3/1999 | Hosaka et al. |
| 5,904,210 | A | 5/1999 | Stump et al. |
| 5,923,270 | A | 7/1999 | Sampo et al. |
| 5,928,309 | A | 7/1999 | Korver et al. |
| 5,953,838 | A | 9/1999 | Steenwyk |
| 5,974,675 | A | 11/1999 | Yamada et al. |
| 6,034,722 | A | 3/2000 | Viney et al. |
| 6,035,254 | A | 3/2000 | Nichols |
| 6,044,316 | A | 3/2000 | Mullins |
| 6,068,060 | A | 5/2000 | Ohtomo et al. |
| 6,095,254 | A | 8/2000 | Homburg |
| 6,112,145 | A | 8/2000 | Zachman |
| 6,138,367 | A | 10/2000 | Raby |
| 6,145,378 | A | 11/2000 | McRobbie et al. |
| 6,154,699 | A | 11/2000 | Williams |
| 6,182,372 | B1 | 2/2001 | Lamm |
| 6,209,232 | B1 | 4/2001 | Ono et al. |
| 6,218,574 | B1 | 4/2001 | Liu et al. |
| 6,226,572 | B1 | 5/2001 | Tojima et al. |
| 6,243,658 | B1 | 6/2001 | Raby |
| 6,246,932 | B1 | 6/2001 | Kageyama et al. |
| 6,246,938 | B1 | 6/2001 | Giletta et al. |
| 6,275,758 | B1 | 8/2001 | Phelps |
| 6,283,222 | B2 | 9/2001 | Gengler et al. |
| 6,304,210 | B1 | 10/2001 | Allison et al. |
| 6,324,455 | B1 | 11/2001 | Jackson |
| 6,351,310 | B1 | 2/2002 | Emge et al. |
| 6,364,028 | B1 | 4/2002 | Ferrell et al. |
| 6,374,147 | B1 | 4/2002 | Rockwood |
| 6,374,169 | B1 | 4/2002 | Demay et al. |
| 6,374,190 | B2 | 4/2002 | Schupfner |
| 6,377,881 | B1 | 4/2002 | Mullins |
| 6,389,345 | B2 | 5/2002 | Phelps |
| 6,389,785 | B1 | 5/2002 | Diekhans et al. |
| 6,421,627 | B1 | 7/2002 | Ericsson |
| 6,774,839 | B2 | 8/2004 | Talbot et al. |
| 6,782,644 | B2 * | 8/2004 | Fujishima et al. ..... 37/348 |

FOREIGN PATENT DOCUMENTS

| | | |
|---|---|---|
| EP | 0 810 419 A2 | 12/1997 |
| EP | 1 178 173 A1 | 2/2002 |
| EP | 1 418 273 A1 | 5/2004 |
| WO | WO 95/28524 | 10/1995 |
| WO | WO 95/34849 | 12/1995 |
| WO | WO 98/54593 | 12/1998 |

* cited by examiner

METHOD AND APPARATUS FOR MACHINE ELEMENT CONTROL

CROSS-REFERENCE TO RELATED APPLICATIONS

Not applicable.

STATEMENT REGARDING FEDERALLY SPONSORED RESEARCH OR DEVELOPMENT

Not applicable

BACKGROUND OF THE INVENTION

This invention relates generally to machine control methods and systems for machines having machine elements, such as for example construction machines such as graders, milling machines, pavers, and slip-forming machines. More particularly, the present invention relates to a machine control method and system using a stationary tracking station that determines the location and orientation of the machine element, and transmits this information to the machine for use in controlling the operation of the machine element.

It is desirable to monitor the position and movement of various types of relatively slow-moving machines, such as for example construction machinery including graders, pavers, and slip-forming, as well as the position, orientation and movement of machine elements associated with such machines. This information can then be used to control the operation of the monitored machines.

While in the past, machine operators have relied on physical references set by surveyors at a job site when operating equipment of this type, automatic machine control systems have also been developed that provide an optical reference, such as a reference beam of laser light, to specify elevation. In such a system, a laser receiver mounted on the grader senses the laser beam and provides an elevation reference. The sensed elevation of the reference laser beam is compared to a set point, either by a machine operator or by an automatic control. The movement of the machine element is then controlled based on this information, either manually by an operator or automatically by an automated control. The set point, that is, the desired vertical position, may be adjusted depending upon the x and y location of the machine at the work site, with this machine location being determined in any of a number of ways.

Total stations have been used both for surveying and for machine control. In a typical surveying application, a total station, positioned at a known location, directs a beam of laser light to a target positioned by a surveyor at a point to be surveyed. The target includes retroreflectors which reflect the beam back to the total station. By measuring the time of flight of the beam, the distance between the total station and the target is determined. By also measuring the direction of the beam from the total station to the target, i.e., the altitude and azimuth angles that define a vector from the total station to the target, the location of the target is precisely determined.

Robotic total stations have been developed that are capable of locating and tracking a target without being attended by an operator. With a robotic total station, the surveyor moves the target around the work site. Servo motors in the robotic total station cause it to rotate toward the target, providing precise angular and distance measurements as the surveyor moves to various locations at the work site. The total station automatically tracks the remote target as it moves, thus providing real-time position data for the target.

Robotic total stations have also been used for machine control. They typically use a single robotic station with single target per machine. The position information is communicated to the machine control system remotely where the control software calculates the machine element position relative to the job plan. Multiple targets on a single machine element have required multiple robotic stations. Such arrangements have been somewhat complicated. There is, therefore, a need for a simplified system using a single total station.

SUMMARY OF THE INVENTION

This need is met by a method of monitoring the location, and the orientation of a machine element according to the present invention. The method includes the steps of: providing a plurality of targets in known positions relative to the machine element; providing a total station at a known location near the machine element; repeatedly, successively determining the location of each target using the total station; and determining the orientation of the machine element based on the locations of the targets.

The step of repeatedly, alternately determining the location of each target using the total station comprises the step of directing a beam of laser light from the total station repeatedly, successively to the targets, and measuring the distances from the total station to each of the targets and the directions to each of the targets.

The step of repeatedly, successively determining the location of each target using the total station comprises the step of directing a beam of laser light from the total station successively to the targets by successively acquiring the targets.

The step of successively acquiring the targets may comprise the step of storing the detected locations of each of the targets and the movement history of each of the targets, and predicting the locations of each of the pair of targets as the laser beam is directed successively to the targets, whereby the reacquisition of the targets is facilitated. This may be done at the robotic station itself or by the machine control system and the predicted position communicated back to the robotic station.

The step of providing a plurality of targets in known positions with respect to the machine element may comprise the step of providing a pair of targets that are fixed in known positions on the machine element and moveable with the machine element.

The step of providing a pair of targets that are fixed in known positions on the machine element and moveable with the machine element may comprise the step of providing a pair of targets that are fixed in position with respect to the machine element.

A method of controlling the movement of a machine element, comprises the steps of: providing a plurality of targets in known positions with respect to a moving machine element; providing a total station at a known location near the moving machine element; repeatedly, successively determining the location of each target using the total station; transmitting the location of each target determined by the total station from the total station to the machine; at the machine, determining the orientation of the machine element based on the locations of the targets; and, at the machine, controlling the movement of the machine element in response to the determined locations of the targets and the determined orientation of the machine element.

The step of repeatedly, successively determining the location of each target using the total station comprises the step of directing a beam of laser light from the total station repeatedly in succession to each of the plurality of targets, and measuring the distances from the total station to each of the plurality of targets and the directions to each of the pair of targets.

The step of repeatedly, successively determining the location of each target using the total station comprises directing a beam of laser light from the total station to the targets by alternately acquiring the targets in succession.

The step of acquiring the targets in succession comprises the step of storing the detected locations of each of the targets and the movement history of each of the targets, and predicting the locations of each of the targets as the laser beam is directed repeatedly in succession to each of targets, whereby the reacquisition of the targets is facilitated.

The step of providing a plurality of targets in known positions with respect to the machine element comprises the step of providing a pair of targets that are fixed in known positions on the machine element and moveable with the machine element.

The step of providing a pair of targets fixed in known positions on the machine element and moveable with the machine element comprises the step of providing a pair of targets that are fixed in position with respect to the machine element.

A system for controlling the movement of a machine element on a machine, comprises: a control on the machine for control of the machine element; a plurality of targets mounted in known positions with respect to a moving machine element; and a total station positioned at a known location near the moving machine element. The total station includes a laser light source for providing a beam of laser light on the targets, a target prediction unit for predicting the locations of each of the targets based on previous locations and movement of the targets, a beam control for directing the beam of laser light on the targets and repeatedly, successively determining the location of each target, and a transmitter for transmitting the locations of each of the targets to the control on the machine. The measured locations of the targets can be used to control the location, orientation, and movement of the machine element.

The total station may further include a measurement unit for measuring the distances from the total station to each of the targets, and for determining the directions to each of the targets. The plurality of targets may comprise a pair of targets.

Accordingly, It is an object of the present invention to provide an improved system and method for controlling a machine and machine element. Other objects and advantages of the invention will be apparent from the following description, the accompanying drawings, and the appended claims.

DETAILED DESCRIPTION OF THE PREFERRED EMBODIMENT

Figure 1:
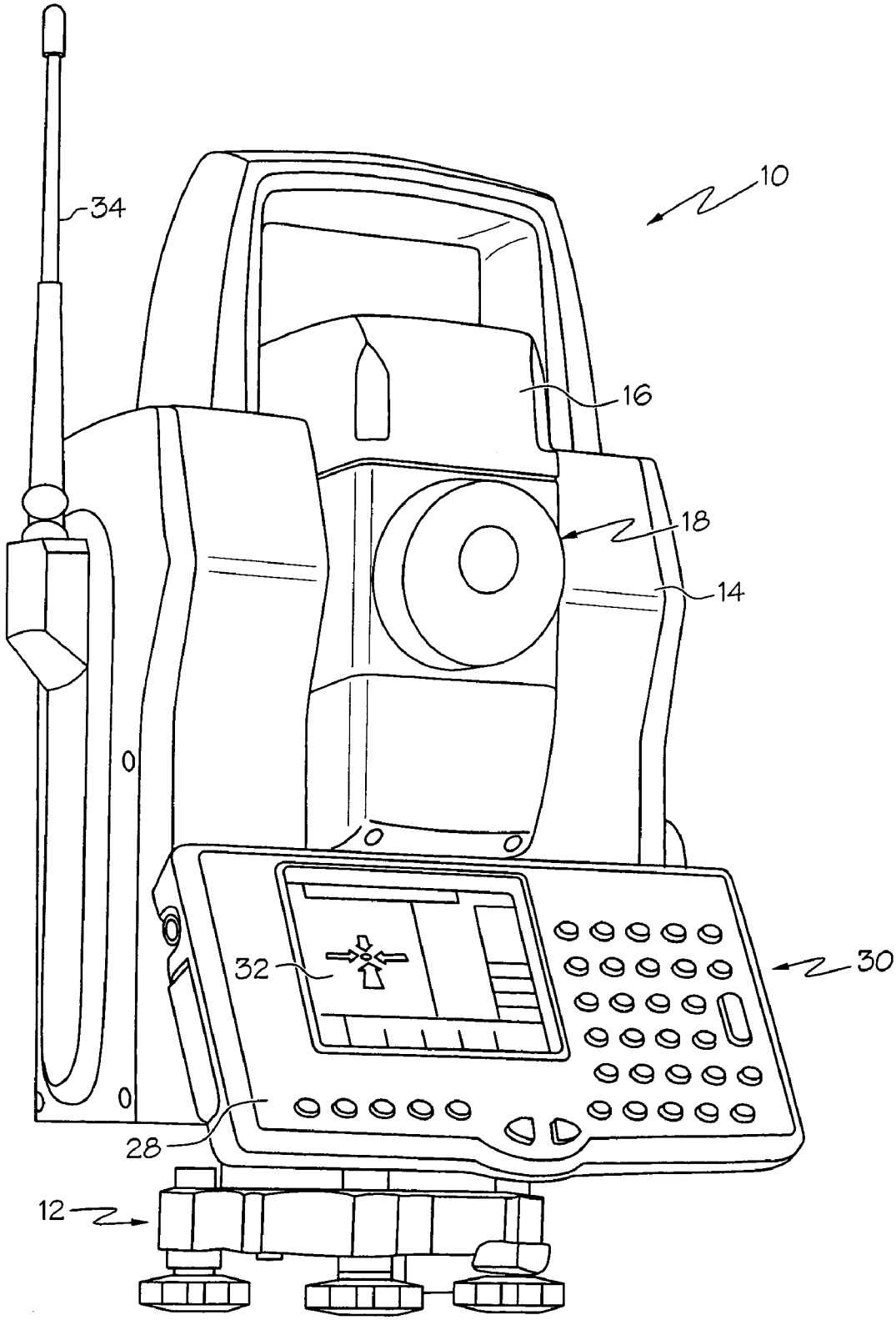
FIG. 1 is a view of a robotic total station of the type used in the method and apparatus for machine element control according to the present invention.
Figure 2:
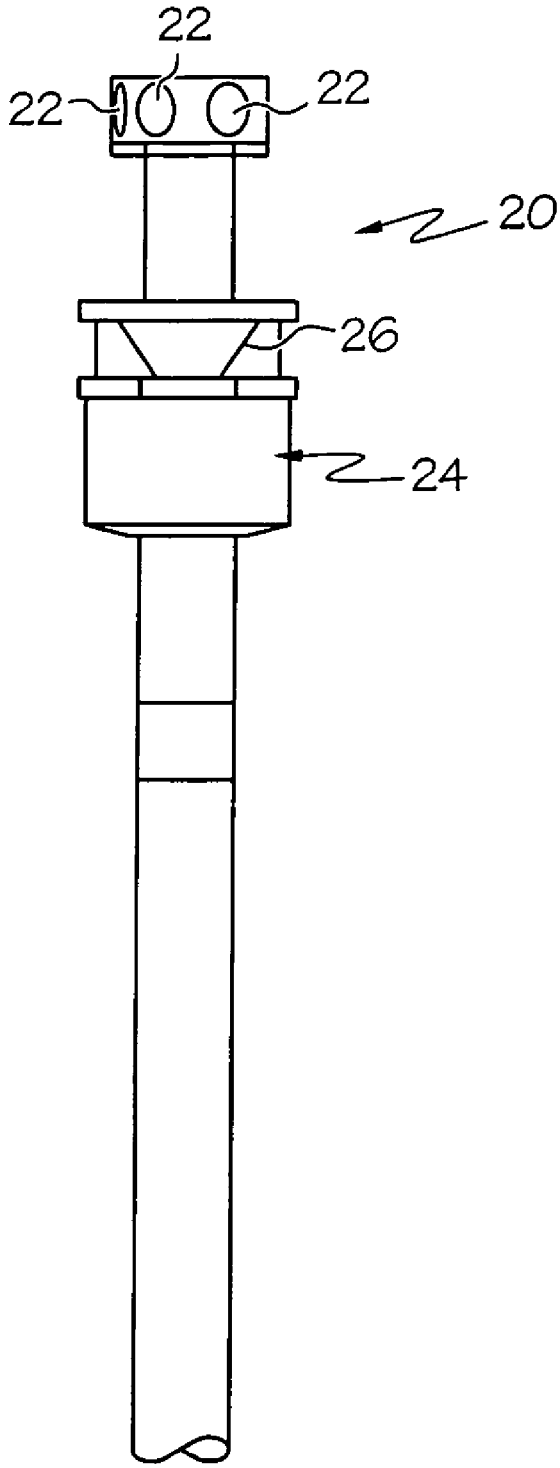
FIG. 2 is a view of a target of the type used in the method and apparatus according to the present invention.
Figure 3:
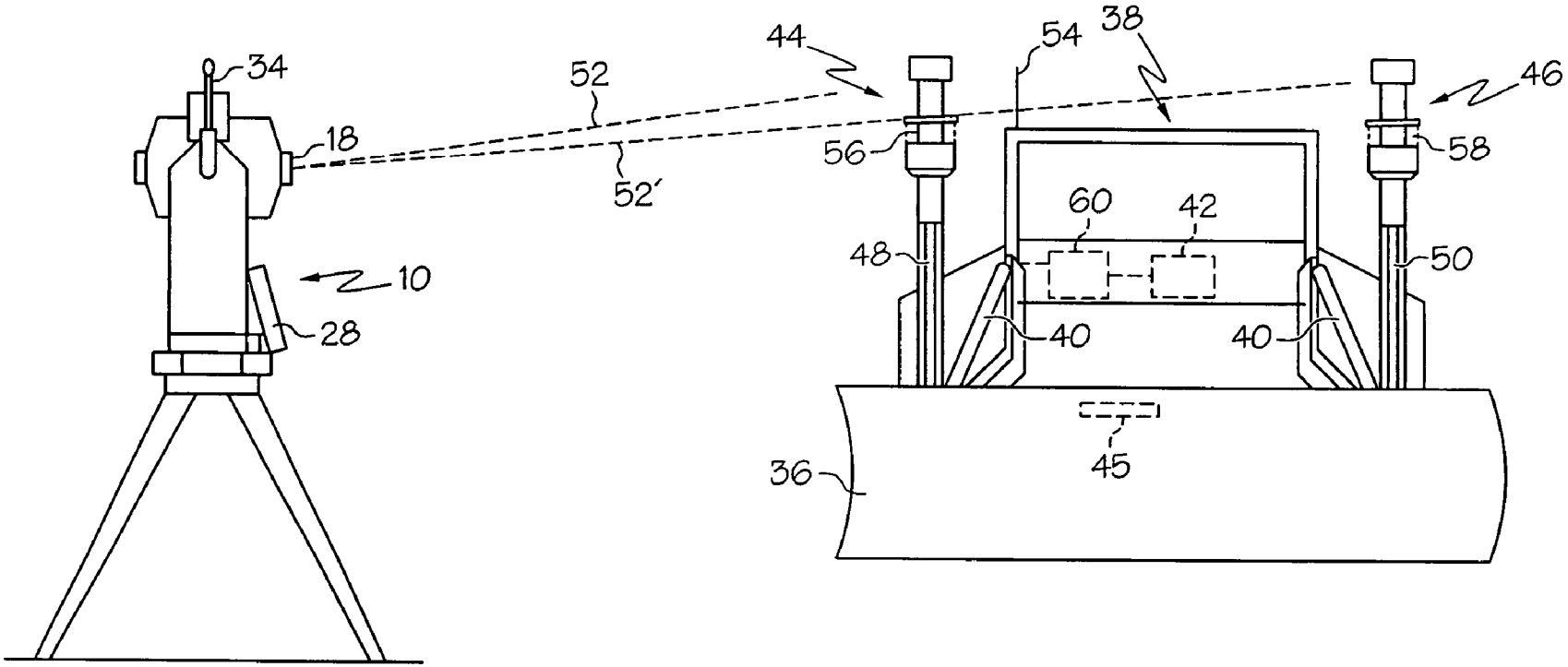
FIG. 3 is a view illustrating the apparatus for machine element control and the method according to the present invention.

Reference is made to FIGS. 1–3, which illustrate the apparatus and method of the present invention for monitoring the location and orientation of a machine element, and controlling the movement of the machine element. FIG. 1 depicts a robotic total station 10, which is comprised of a base portion 12, a rotational alidade portion 14, and an electronic distance-measuring portion 16. Rotational alidade portion 14 rotates on base portion 12 about a vertical axis, with a full 360-degree range of rotation. Electronic distance-measuring portion 16 similarly rotates within rotational alidade portion 14 about a horizontal axis. With this arrangement, it is possible for the distance-measuring portion 16 to be oriented toward a target in virtually any direction so that the distance can be measured from the total station 10 to the target.

The electronic distance-measuring portion 16 transmits a beam of laser light through lens 18 toward a target 20. As seen in FIG. 2, target 20 includes a plurality of retroreflective elements 22 which are positioned circumferentially therearound. Retroreflective elements 22 may be retroreflective cubes or other reflectors which have the property of reflecting received light back in the direction from which it originated. Target 20 also includes an LED strobe 24 which directs a strobe light upward onto inverted conical reflector 26. The light is reflected outward from the reflector 26 in all directions and provides a means of assisting the robotic total station in acquiring or in reacquiring the target 20. The frequency of the strobe light or its frequency of pulsation may be set to differ from that of other targets, thereby permitting a total station to distinguish among targets.

A beam of laser light transmitted by the total station 10 of FIG. 1 to the target 20 is reflected back from the target 20, and is then received by the electronic distance-measuring portion 16 through lens 18. The laser light may, in other total station arrangements, however, be received through a separate lens. Preferably, the beam of laser light is pulsed, facilitating the measurement of the time required for the light to travel from the total station 10 to the target 20 and return. Given an accurate time-of-flight measurement, the distance between the total station and the target can be computed directly. The azimuth, angle and altitude angle measurements, in conjunction with the computed distance between the total station 10 and the target 20, then provide the polar coordinates of the location of the target 20 with respect to the total station 10.

The robotic total station 10 includes a control 28, having a keypad 30 and display 32. The robotic total station 10 includes a servo mechanism (not shown) which orients the electronic distance-measuring portion 16, by controlling its rotation around the horizontal axis, and controlling the rotation of alidade portion 14 about a vertical axis. The robotic total station 10 further includes a radio transmitter (not shown) and antenna 34 which permit communication of location and measurement data to a remote location.

Reference is made to FIG. 3, which illustrates diagrammatically a system for controlling the movement of a machine element 36 on a machine 38. The machine element is shown as a blade 36 that is moved on machine 38 by hydraulic cylinders 40. A control 42 on the machine 38 controls the operation of the machine 38, including the movement of the blade 36 by cylinders 40. A pair of targets 44 and 46 are mounted in known positions with respect to the machine element 36, by means of masts 48 and 50. An inclinometer 45 provides an indication of the angular pitch of the machine element 36.

Total station 10 is positioned at a known location near the machine 38 and machine element 36. The total station 10 includes a laser light source for providing a beam of laser light from lens 18 that can be directed to either of the targets 44 and 46. The control 28 in the total station 10 includes a target prediction unit for predicting the locations of each of the pair of targets 44 and 46 based on previous locations and movement of the targets or alternatively the predicted position information is calculated by control 42 and transmitted back to the total station 10. The control 28 includes a beam control that directs the beam of laser light on the targets 44 and 46, and repeatedly, alternately determines the location of each target. The path of the beam to target 44 is labeled as 52 and the path of the beam to target 46 is labeled as 52'. The transmitter in the total station 10 transmits the locations of each of the targets 44 and 46 via antenna 34 and antenna 54 on the machine 38 to the control 42 on the machine 38.

It will be appreciated that the measured locations of the targets 44 and 46 can be used to determine the desired location, orientation, and movement of the machine element 36 relative to the total station 10. This information can then be used by control 42 to operate the machine 38.

The location and the orientation of machine element 36 is monitored by the total station 10 and this information is provided to the machine 38 where it can be used for automatic or manual control of the element 36. The pair of targets 44 and 46 are provided in known positions relative to the machine element. In FIG. 3, arrangement is illustrated, for example, in which the targets are mounted symmetrically on masts 48 and 50 at each end of the machine element 36. The total station 10 is providing at a known location near the machine element 36. In the method of the present invention, the location of each of the targets 44 and 46 is repeatedly, alternately determined using the robotic total station 10. The location and orientation of the machine element 36 can then be determined by the control 42 based on the locations of the pair of targets 44 and 46. It will be appreciated that a plurality of targets, such as three or four targets, may be used, with the total station repeatedly, successively determining the position of each of the plurality of targets. Such an arrangement may provide greater accuracy and may also facilitate operation of the system if the total station is unable to acquire one of the targets.

The beam of laser light is directed alternately to one and then to the other of the pair of targets 44 and 46 along paths 52 and 52' in relatively rapid fashion. The targets are alternately acquired by the robotic total station 10 with the help of strobed pulses of light reflected outward in all directions from conical mirrors 56 and 58. The measured locations of the targets are stored in the control 28 or alternatively control 42. This provides the movement history of each of the targets, and permits the further locations of each of the targets to be predicted by a target prediction unit in control 28 or transmitted back to it from control 42. This, in turn, facilitates their acquisition as the laser beam is directed alternately to one and then to the other of the pair of targets, or to each of the targets in succession in the event that more than two targets are used. It will be appreciated that, based on the locations measured for targets 44 and 46, the orientation of the machine element 36 may also be determined by control 42. Control 42 may also be responsive to inclinometer 45 which provides an indication of the orientation of the element 36 from one end to the other. The frequency with which the total station switches between the two targets will vary, depending upon the speed with which the machine element 36 and targets 44 and 46 are to be moved.

If desired, the pair of targets 44 and 46 may be fixed in symmetrical positions with respect to the machine element 36, although this is not required. All that is needed is that the targets be in a known, fixed relationship with regard to the element 36. If the position of the targets is known, the position of the machine element is also known. It will be further appreciated that although the description is of an arrangement having two targets, a system employing three or more targets may also be utilized.

It will be appreciated that once the locations of the targets are determined, this information can then be used to control the movement of the machine element. The location information is transmitted to the machine 38 and the orientation of the machine element 36 is determined by the control 42. For example, a desired worksite contour may be stored in computer 60 and used by the control 42 to control element 36 to achieve this contour. The desired surface configuration of an area to be paved may be stored in the computer 60, for example, if a paver is being controlled. The movement of the machine element 36 is controlled by control 40, either automatically or manually, so that the machine element 36 moves along a desired path.

While certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A method of monitoring the location, and the orientation of a machine element, comprising:

providing a plurality of targets in known positions relative to the machine element, providing a total station at a known location near said machine element, repeatedly, successively determining a measured location of each target using said total station, determining orientation of said machine element based on the measured locations of said plurality of targets, determining predicted future locations of said targets, and reacquiring each of said targets using said predicted future locations.

2. The method of claim 1 in which the step of repeatedly, successively determining a measured location of each target using said total station comprises directing a beam of laser light from said total station repeatedly in succession to each of said plurality of targets, and measuring distances from said total station to each of said plurality of targets and directions to each of said plurality of targets.

3. The method of claim 1, in which the step of repeatedly, successively determining a measured location of each target using said total station comprises directing a beam of laser light from said total station to said targets by acquiring said targets in succession.

4. The method of claim 1, in which the step of providing a plurality of targets in known positions with respect to the machine element comprises the step of providing a pair of targets that are fixed in known positions on said machine element and moveable with said machine element.

5. The method of claim 4, in which the step of providing a pair of targets that are fixed in known positions on said machine element and moveable with said machine element comprises the step of providing a pair of targets that are fixed in symmetrical positions with respect to said machine element.

6. The method of claim 1, further comprising storing the measured locations of each of said targets and movement history of each of said targets.

7. A method of controlling the movement of a machine element, comprising:

providing a plurality of targets in known positions with respect to a moving machine element, providing a total station at a known location near said moving machine element, repeatedly, successively determining a measured location of each target using said total station, transmitting the measured location of each target determined by the total station from the total station to the machine, at the machine, determining orientation of said machine element based on the measured locations of said targets, at the machine controlling movement of the machine element in response to the measured locations of said targets and the determined orientation of said machine element, determined predicted future locations of said targets, and reacquiring each of said targets using said predicted future locations.

8. The method of claim 7, in which the step of repeatedly, successively determining a measured location of each target using said total station comprises directing a beam of laser light from said total station repeatedly in succession to each of said plurality of targets, and measuring the distances from said total station to each of said plurality of targets and the directions to each of said plurality of targets.

9. The method of claim 7, in which the step of repeatedly, successively determining a measured location of each target using said total station comprises directing a beam of laser light from said total station to said targets by acquiring said targets in succession.

10. The method of claim 7, in which the step of providing a plurality of targets in known positions with respect to said machine element comprises the step of providing a pair of targets that are fixed in known positions on said machine element and moveable with said machine elements.

11. The method of claim 10, in which the step of providing a pair of targets that are fixed in known positions on said machine element and moveable with said machine element comprises the step of providing a pair of targets that are fixed in symmetrical positions with respect to said machine element.

12. The method of claim 7, further comprising storing the measured location of each of said targets and movement history of each of said targets.

13. A system controlling the movement of a machine element on a machine comprising:

a control on said machine controlling said machine element;

a plurality of targets mounted in known positions with respect to a moving machine element; and a total station positioned at a known location near said moving machine element, said total station including a laser light source providing a beam of laser light on said targets.

a target prediction unit predicting future locations of each of said targets based on previous locations and movement of the targets, a beam control directing the beam of laser light on said targets and repeatedly, successively reacquiring each of the targets based on said predicted future location, and a transmitter transmitting measured locations of each of the targets to the control on said machine, said control using the measured locations of the targets to determine the location, orientation, and movement of the machine element.

14. The system of claim 13, in which the total station further includes a measurement unit for measuring the distances from said total station to each of said targets and the directions to each of said targets.

15. The system of claim 13, in which said plurality of targets comprises a pair of targets.

* * * * *

UNITED STATES PATENT AND TRADEMARK OFFICE

CERTIFICATE OF CORRECTION

PATENT NO. : 7,168,174 B2
APPLICATION NO. : 11/079846
DATED : January 30, 2007
INVENTOR(S) : Piekutowski It is certified that error appears in the above-identified patent and that said Letters Patent is hereby corrected as shown below:

Column 6, Line 48 “claim 1 in” should read --claim 1, in--;

Column 7, Line 25 “determined” should read --determining--;

Column 8, Line 2 “machine elements.” should read --machine element.--;

Column 8, Line 10 “location” should read --locations--; and

Column 8, Line 21, “targets.” should read --targets,--.

Signed and Sealed this

Twenty-fifth Day of December, 2007

JON W. DUDAS
*Director of the United States Patent and Trademark Office*